US011034909B2

(12) United States Patent
Lançon

(10) Patent No.: US 11,034,909 B2
(45) **Date of Patent: *Jun. 15, 2021**

(54) LUBRICANT POLYMERS

(71) Applicant: TOTAL MARKETING SERVICES, Puteaux (FR)

(72) Inventor: Denis Lançon, Chassieu (FR)

(73) Assignee: TOTAL MARKETING SERVICES, Puteaux (FR)

( * ) Notice: Subject to any disclaimer, the term of this patent is extended or adjusted under 35 U.S.C. 154(b) by 0 days.

This patent is subject to a terminal disclaimer.

(21) Appl. No.: 16/310,630

(22) PCT Filed: Jun. 16, 2017

(86) PCT No.: PCT/EP2017/064735
§ 371 (c)(1),
(2) Date: Dec. 17, 2018

(87) PCT Pub. No.: WO2017/216326
PCT Pub. Date: Dec. 21, 2017

(65) Prior Publication Data

US 2019/0177642 A1 Jun. 13, 2019

(30) Foreign Application Priority Data

Jun. 17, 2016 (EP) ..... 16305739

(51) Int. Cl.

| | |
|---|---|
| ***C10M 145/14*** | (2006.01) |
| ***C10M 169/04*** | (2006.01) |
| ***C10M 133/54*** | (2006.01) |
| ***C10M 161/00*** | (2006.01) |
| *C10N 30/06* | (2006.01) |
| *C10N 30/08* | (2006.01) |
| *C10N 30/12* | (2006.01) |
| *C10N 30/00* | (2006.01) |
| *C10N 40/25* | (2006.01) |
| *C10N 50/04* | (2006.01) |

(52) U.S. Cl.
CPC ..... *C10M 145/14* (2013.01); *C10M 133/54* (2013.01); *C10M 161/00* (2013.01); *C10M 169/041* (2013.01); *C10M 169/044* (2013.01); *C10M 2203/003* (2013.01); *C10M 2203/1006* (2013.01); *C10M 2209/084* (2013.01); *C10M 2215/04* (2013.01); *C10M 2215/26* (2013.01); *C10N 2030/06* (2013.01); *C10N 2030/08* (2013.01); *C10N 2030/12* (2013.01); *C10N 2030/30* (2020.05); *C10N 2030/52* (2020.05); *C10N 2040/25* (2013.01); *C10N 2040/252* (2020.05); *C10N 2050/04* (2013.01)

(58) Field of Classification Search
CPC ..... C10N 2040/26; C10N 2020/02; C10N 2030/02
See application file for complete search history.

(56) References Cited

U.S. PATENT DOCUMENTS

| | | | | |
|---|---|---|---|---|
| 6,124,249 | A | 9/2000 | Seebauer et al. | |
| 2006/0240999 | A1* | 10/2006 | Placek | C10M 145/14 508/469 |
| 2010/0004149 | A1 | 1/2010 | Johnson et al. | |
| 2010/0048439 | A1 | 2/2010 | Maehling et al. | |
| 2011/0092403 | A1 | 4/2011 | Lancon et al. | |
| 2012/0329694 | A1* | 12/2012 | Gelder | C10M 145/14 508/468 |
| 2014/0031269 | A1* | 1/2014 | Price | C10M 149/00 508/306 |

FOREIGN PATENT DOCUMENTS

| | | | |
|---|---|---|---|
| EP | 0153209 | A2 | 8/1985 |
| EP | 0823472 | A1 | 2/1998 |
| EP | 1418187 | A2 | 5/2004 |
| EP | 2607465 | A1 | 6/2013 |
| JP | 2002-167591 | A | 6/2002 |
| JP | 2008-518051 | A | 5/2008 |
| JP | 2010-144017 | A | 7/2010 |
| JP | 2011-524926 | A | 9/2011 |
| JP | 2012-507613 | A | 3/2012 |
| JP | 2014-512432 | A | 5/2014 |
| WO | 99/10454 | A2 | 3/1999 |
| WO | 2006/047393 | A1 | 5/2006 |
| WO | 2010/053890 | A1 | 5/2010 |
| WO | 2012/135054 | A1 | 10/2012 |
| WO | 2014/031154 | A1 | 2/2014 |

OTHER PUBLICATIONS

Aug. 9, 2017 International Search Report issued in International Patent Application No. PCT/EP2017/064735.

(Continued)

*Primary Examiner* — Vishal V Vasisth

(74) *Attorney, Agent, or Firm* — Oliff PLC

(57) ABSTRACT

Lubricant compositions include copolymers of monomers selected from C6-C10 alkyl methacrylate monomers, and monomers selected from C10-C18 alkyl methacrylate monomers, and a base oil or comprising a copolymer obtained by combining at least monomers selected from C6-C10 alkyl methacrylate monomers, and monomers selected from C10-C18 alkyl methacrylate monomers in a mixture and co-polymerizing the monomers. The methods for the preparation of the lubricant compositions, and lubricants uses.

10 Claims, No Drawings

(56) References Cited

OTHER PUBLICATIONS

Oct. 4, 2019 Office Action issued in U.S. Appl. No. 16/309,128.
Jan. 21, 2020 Office Action issued in U.S. Appl. No. 16/309,128.
Mar. 3, 2020 Advisory Action issued in U.S. Appl. No. 16/309,128.
Apr. 2, 2020 Office Action issued in European Patent Application No. 20159729.1.
Sep. 14, 2020 Third Party Observation in European Patent Application No. 17729882.5.
Dec. 1, 2020 Office Action issued in Japanese Patent Application No. 2018-565308.
Dec. 16, 2020 Office Action issued in Japanese Patent Application No. 2018-565415.

* cited by examiner

LUBRICANT POLYMERS

This application is a 371 of PCT/EP2017/064735, filed Jun. 16, 2017.

FIELD OF INVENTION

This invention relates to a lubricant composition comprising a copolymer, a method for its production and its uses.

TECHNICAL BACKGROUND

One of the primary function of lubricants is to decrease friction. Frequently, however, lubricating oils need additional properties to be used effectively. For example, lubricants used in large diesel engines, such as, for example, marine diesel engines, are often subjected to operating conditions requiring special considerations.

Two-stroke marine engines are of crosshead design also named slow-speed engines, they are used for the largest, deep ocean going vessels and certain other industrial applications. Two-stroke Slow-speed engines are unique in size and method of operation. The output of these engines can be as high as 100,000 horsepower (84 MW) with engine revolutions of 80 to about 200 revolutions per minute (rpm). Two-stroke Slow-speed marine engines have a high to very high power range (600 to 6000 kW per cylinder). These engines always consist of two separately lubricated parts, namely the piston/cylinder assembly lubricated with a highly viscous cylinder oil, generally of SAE 50 or 60 grade, and the crankshaft, crossheads, conrods, lubricated by a less viscous system oil, generally of SAE 30 grade.

The cylinders are lubricated on a total loss basis with the cylinder oil being injected separately into each cylinder by means of lubricators positioned around the cylinder liner. Oil is distributed to the lubricators by means of pumps, which are, in modern engine designs, actuated to apply the oil directly onto the rings to reduce oil wastage. The unique design of these engines creates the need for lubricants with enhanced rheological properties. Accordingly, lubricants used in a marine engine must protect the engine parts from corrosion which can reduce engine efficiency and lifetime. Also, the residual fuels commonly used in these diesel engines typically contain significant quantities of sulfur. During the combustion process, the sulfur oxide can combine with water to form sulfuric acid, the presence of which leads to corrosive wear. In particular, areas around the cylinder liners and piston rings can be corroded and worn by the acid. Therefore, it is important for marine engine to resist such corrosion and wear by being properly lubricated.

To prevent corrosion, the lubricant is applied to the cylinder wall, typically by a pulse lubricating system or by spraying the lubricant onto the piston's rings pack through an injector. The lubrication in a two-stroke marine engine differs significantly from any other type of engine. However, it has been seen that in some cases, said system may not guarantee the adequate availability of lubricant, notably onto the cylinder liner, because the jet of lubricant is often disrupted into droplets before its impact. The lubricant droplets are then entrained with the air flow directly within the combustion chamber. This induces a large efficiency drop of the lubrication process and an increase of the corrosion process in marine engines.

EP 0 823 472 A1 discloses viscosity index improving additives for phosphate ester-containing hydraulic fluids. These additives are not for oil-based lubricant compositions.

WO 99/10454 A2 discloses the addition of a mixture selected from high molecular weight and low molecular weight alkyl (meth)acrylates copolymers to lubricating oils for improving their low temperature fluidity.

US 2010/048439 A1 discloses the use of copolymers comprising an α-olefins, at least one alkenyl ester and at least one ester of an α,β-unsaturated carboxylic acid with higher alcohols as an additive for fuel oils and lubricants.

EP 0 153 209 A2 discloses the use of methacrylate copolymers as polyfunctional viscosity index improving additives for oil lubricants.

EP 1 418 187 A2 discloses alkyl (meth)acrylates copolymers as additives to provide excellent low temperature properties and shear stability to lubricating oils.

None of the additives known for lubricating in marine engines has proved entirely satisfactory.

Thus, there is a need for a lubricant additive that will provide effective corrosion resistance. Additionally, there is a need for a lubricant additive that will provide any rheology improvements, notably jet rheology, in order to enhance lubricating efficacy and reduce the corrosion.

SUMMARY

We have found new copolymers that can modify the rheology, notably the jet rheology, of a marine lubricant to provide enhanced lubrication properties. In particular, marine engine lubricating oils comprising the copolymers of the disclosure as an additive, surprisingly allow reducing the disruption of the lubricant jet before its impact, notably onto the piston's rings pack, with respect to prior art oils, thereby leading to better lubrication and less engine cylinder wear and corrosion.

In a first aspect, the present disclosure provides a lubricant composition comprising a base oil and a copolymer of alkyl methacrylate monomers, wherein said alkyl methacrylate monomers comprise at least:

Monomers (A) selected from C6-C10 alkyl methacrylate monomers,

Monomers (B) selected from C10-C18 alkyl methacrylate monomers.

According to a favourite embodiment, monomers (B) comprise at least one C12 alkyl methacrylate monomer.

In a second aspect, the present disclosure provides a lubricant composition comprising a copolymer obtained by combining alkyl methacrylate monomers, wherein said alkyl methacrylate monomers comprise at least:

Monomers (A) selected from C6-C10 alkyl methacrylate monomers,

Monomers (B) selected from C10-C18 alkyl methacrylate monomers, and a base oil.

According to a favourite embodiment, monomers (B) comprise at least one C12 alkyl methacrylate monomer.

In a third aspect, the present disclosure provides a method for producing a marine lubricant of the first and the second aspects.

In a fourth aspect, the present disclosure provides the use of the marine lubricant of the first and the second aspects for lubricating two-stroke marine engine.

Alternately, the present disclosure provides a method for lubricating a two-stroke marine engine said method comprising application to said two-stroke marine engine of the marine lubricant of the first and the second aspects.

In a fifth aspect, the present disclosure provides the use of the marine lubricant of the first and the second aspects for reducing the disruption of the lubricant jet before its impact, notably onto the piston's rings pack.

Alternately, the present disclosure provides a method for reducing the disruption of the lubricant jet before its impact, notably onto the piston's rings pack said method comprising formulating the marine lubricant according to the first and the second aspects.

All publications referenced herein are incorporated by reference in their entirety to the extent they are not inconsistent with the teachings presented herein.

DETAILED DESCRIPTION

In the first aspect, the present disclosure provides a lubricant composition comprising a base oil and a copolymer of alkyl methacrylate monomers, wherein said alkyl methacrylate monomers comprise at least:

Monomers (A) selected from C6-C10 alkyl methacrylate monomers,

Monomers (B) selected from C10-C18 alkyl methacrylate monomers.

Monomers (A) and (B) can be linear or branched.

The copolymer used in the lubricant composition according to the invention is prepared from a mixture of monomers that comprises at least two monomers: one monomer (A) and one monomer (B), distinct from one another.

According to a favourite embodiment, monomers (B) comprise at least one C12 alkyl methacrylate monomer.

Preferably, monomers (B) comprise 50 to 80% by weight of C12 alkyl methacrylate as compared to the total weight of monomers (B), even more preferably 55 to 70% by weight.

Advantageously, monomers (B) further comprise at least one C14 alkyl methacrylate monomer.

Preferably, monomers (B) comprise 15 to 40% by weight of C14 alkyl methacrylate as compared to the total weight of monomers (B), even more preferably 20 to 30% by weight.

Such copolymers can comprise units derived from other monomers. Other monomers can be selected for example from C1-C5 alkyl methacrylates and C16-C24 alkyl methacrylates, cross-linking monomers, C1-C24 alkyl acrylates, styrene . . . .

Preferably, monomers (A) selected from C6-C10 alkyl methacrylate monomers, and monomers (B) selected from C10-C18 alkyl methacrylate monomers represent at least 75% by weight of the total weight of monomers used to prepare the copolymer, advantageously they represent at least 90%, even more preferably at least 95%, or better 99% by weight.

Preferably, the weight ratio of monomers (B) to monomers (A) in the copolymer is about 99:1 to about 10:90.

Advantageously, monomers (A) comprise at least 50% by weight of C8 alkyl methacrylate, as compared to the total weight of monomers (A), even more preferably at least 75% by weight, even better at least 90% by weight, and even more advantageously at least 99% by weight.

According to a favourite variant, monomers (A) are branched, like for example 2-ethyl hexyl methacrylate, isodecylmethacrylate.

Advantageously, monomers (B) comprise a mixture of at least C10 alkyl methacrylate, C12 alkyl methacrylate, C14 alkyl methacrylate, C16 alkyl methacrylate and C18 alkyl methacrylate.

More advantageously, monomers (B) comprise a mixture of at least:

- 0.1 to 2% by weight of C10 alkyl methacrylate as compared to the total weight of monomers (B),
- 50 to 80% by weight of C12 alkyl methacrylate as compared to the total weight of monomers (B),
- 15 to 40% by weight of C14 alkyl methacrylate as compared to the total weight of monomers (B),
- 2 to 12% by weight of C16 alkyl methacrylate as compared to the total weight of monomers (B) and
- 0.1 to 1% by weight of C18 alkyl methacrylate as compared to the total weight of monomers (B).

Particularly, monomers (B) comprise a mixture of at least:

- 1 to 2% by weight of C10 alkyl methacrylate as compared to the total weight of monomers (B),
- 55 to 70% by weight of C12 alkyl methacrylate as compared to the total weight of monomers (B),
- 20 to 30% by weight of C14 alkyl methacrylate as compared to the total weight of monomers (B),
- 4 to 10% by weight of C16 alkyl methacrylate as compared to the total weight of monomers (B) and
- 0.1 to 0.5% by weight of C18 alkyl methacrylate as compared to the total weight of monomers (B).

According to a favourite variant, monomers (B) are linear, like for example n-C10-alkyl methacrylate, n-C11-alkyl methacrylate, lauryl methacrylate (n-C12-alkyl methacrylate), n-C13-alkyl methacrylate, myristyl methacrylate (n-C14-alkyl methacrylate), n-C15-alkyl methacrylate, n-C16-alkyl methacrylate, n-C17-alkyl methacrylate, n-C18-alkyl methacrylate.

The ratio of monomers in all aspects of the disclosure can be adjusted to manipulate the characteristics of the copolymer as desired. For example, the monomers can be present in ratios of C10-C18-alkyl methacrylate to C6-C10-alkyl methacrylate of 10:90, 15:85, 20:80, 25:75, 30:70, 35:65, 40:60, 45:55, 50:50, 55:45, 60:40, 65:35, 70:30, 75:25, 80:20, 85:15, 90:10, 95:5, and 99:1. Notably, the monomers can be present in ratios of C10-C18-alkyl methacrylate to C8-alkyl methacrylate of 10:90, 15:85, 20:80, 25:75, 30:70, 35:65, 40:60, 45:55, 50:50, 55:45, 60:40, 65:35, 70:30, 75:25, 80:20, 85:15, 90:10, 95:5, and 99:1.

In some embodiments of all aspects of the disclosure, the C8 alkyl methacrylate is linear or branched C8 alkyl. In some favourite embodiments, the C8 alkyl methacrylate is 2-ethylhexyl methacrylate.

According to an even more favourite embodiment, the copolymer is a copolymer of 2-ethyl hexyl methacrylate and a mixture of monomers comprising C10 alkyl methacrylate, C12 alkyl methacrylate, C14 alkyl methacrylate, C16 alkyl methacrylate and C18 alkyl methacrylate.

According to another favourite embodiment, the copolymer is a copolymer of a mixture of monomers comprising C10 alkyl methacrylate, C12 alkyl methacrylate, C14 alkyl methacrylate, C16 alkyl methacrylate and C18 alkyl methacrylate and a C8 alkyl methacrylate, wherein the mass ratio of the mixture in the copolymer to C8 alkyl methacrylate monomers in the copolymer is about 99:1 to about 10:90 by weight.

According to another favourite embodiment, the copolymer is a copolymer of a mixture of monomers comprising at least, or even more preferably consisting of: a C8 alkyl methacrylate, a C12 alkyl methacrylate, a C14 alkyl methacrylate, and a C16 alkyl methacrylate, and they are present in the mixture in weight ratio of:

- from 5 to 30% C8 alkyl methacrylate,
- from 40 to 70% C12 alkyl methacrylate,
- from 12 to 35% C14 alkyl methacrylate,
- from 1 to 12% C16 alkyl methacrylate,
- from 0.1 to 15%, preferably from 0.5 to 10%, even more preferably from 1 to 5% other methacrylates, by weight with regards to the total weight of the mixture.

Typically, copolymers according to the disclosure have an average Root Mean Square Radius of Gyration (Rg) as measured by Hydrodynamic Column Chromatography-Multi Angle Light Scattering (HCC-MALS) from about 100 to about 200 (nm) Rg, from about 120 to about 190 (nm), from about 130 to 180, or from about 140 to about 170 (nm) Rg.

In the second aspect, the present disclosure provides a lubricant composition comprising a copolymer obtained by combining and polymerizing alkyl methacrylate monomers, wherein said alkyl methacrylate monomers comprise at least:

Monomers (A) selected from C6-C10 alkyl methacrylate monomers,

Monomers (B) selected from C10-C18 alkyl methacrylate monomers.

Favourite embodiments according to the second aspect are identical to those disclosed above for the first aspect.

The copolymer may be synthesized by conventional methods for vinyl addition polymerization known to those skilled in the art, such as, but not limited to, solution polymerization, precipitation polymerization, and dispersion polymerizations, including suspension polymerization and emulsion polymerization.

In some embodiments, the polymer is formed by suspension polymerization, wherein monomers that are insoluble in water or poorly soluble in water are suspended as droplets in water. The monomer droplet suspension is maintained by mechanical agitation and the addition of stabilizers. Surface active polymers such as cellulose ethers, poly(vinyl alcohol-co-vinyl acetate), poly(vinyl pyrrolidone) and alkali metal salts of (meth)acrylic acid containing polymers and colloidal (water insoluble) inorganic powders such as tricalcium phosphate, hydroxyapatite, barium sulfate, kaolin, and magnesium silicates can be used as stabilizers. In addition, small amounts of surfactants such as sodium dodecylbenzene sulfonate can be used together with the stabilizer(s). Polymerization is initiated using an oil soluble initiator. Suitable initiators include peroxides such as benzoyl peroxide, peroxy esters such as tert-butylperoxy-2-ethylhexanoate, and azo compounds such as 2,2'-azobis(2-methylbutyronitrile). At the completion of the polymerization, solid polymer product can be separated from the reaction medium by filtration and washed with water, acid, base, or solvent to remove unreacted monomer or free stabilizer.

In other embodiments the polymer is formed by emulsion polymerization, one or more monomers are dispersed in an aqueous phase and polymerization is initiated using a water soluble initiator. The monomers are typically water insoluble or very poorly soluble in water, and a surfactant or soap is used to stabilize the monomer droplets in the aqueous phase. Polymerization occurs in the swollen micelles and latex particles. Other ingredients that might be present in an emulsion polymerization include chain transfer agents such as mercaptans (e.g. dodecyl mercaptan) to control molecular weight, electrolytes to control pH, and small amounts of organic solvent, preferably water soluble organic solvents, including but not limited acetone, 2-butanone, methanol, ethanol, and isopropanol, to adjust the polarity of the aqueous phase. Suitable initiators include alkali metal or ammonium salts of persulfate such as ammonium persulfate, water-soluble azo compounds such as 2,2'-azobis(2-amino-propane)dihydrochloride, and redox systems such as Fe(II) and cumene hydroperoxide, and tert-butyl hydroperoxide-Fe(II)-sodium ascorbate. Suitable surfactants include anionic surfactants such as fatty acid soaps (e.g. sodium or potassium stearate), sulfates and sulfonates (e.g. sodium dodecyl 20 benzene sulfonate), sulfosuccinates (e.g. dioctyl sodium sulfosuccinate); non-ionic surfactants such as octylphenol ethoxylates and linear and branched alcohol ethoxylates; cationic surfactants such as cetyl trimethyl ammonium chloride; and amphoteric surfactants. Anionic surfactants and combinations of anionic surfactants and non-ionic surfactants are most commonly used. Polymeric stabilizers such as poly(vinyl alcohol-co-vinyl acetate) can also be used as surfactants. The solid polymer product free of the aqueous medium can be obtained by a number of processes including destabilization/coagulation of the final emulsion followed by filtration, solvent precipitation of the polymer from latex, or spray drying of the latex.

The polymer can be isolated by conventional methods known to those skilled in the art, such as, but not limited to, solvent exchange, evaporation of solvent, spray drying and freeze-drying.

The characteristics of the copolymer obtained by combining alkyl methacrylate monomers, wherein said alkyl methacrylate monomers comprise at least:

Monomers (A) selected from C6-C10 alkyl methacrylate monomers,

Monomers (B) selected from C10-C18 alkyl methacrylate monomers, in a mixture and co-polymerizing can be manipulated by controlling the additional reagents added to the polymerization mixture. These reagents include, but are not limited to, initiator systems and surfactants.

The type and amount of initiator system used in the polymerization mixture can influence the properties of the resulting copolymer. An initiator system can be a single initiator compound (e.g., a persulfate salt) or a mixture of two or more components (e.g., hydrogen peroxide and sodium ascorbate). In some examples, the initiator system can include an oxidant, a reductant, and optionally a metal salt. The oxidant can be a persulfate, such as, for example, ammonium persulfate, or a peroxide, such as, for example, hydrogen peroxide ($H_2O_2$) or tert-butyl hydroperoxide (TBHP). A desirable copolymer may be obtained, for example, when the polymerization mixture includes tert-butyl hydroperoxide in about 0.01 to about 0.06 mass percent of all monomers in the mixture. In other examples, the mixture may include tert-butyl hydroperoxide in about 0.01 to about 0.03 mass percent of the monomers in the mixture. In some examples, the mixture further comprises tert-butyl hydroperoxide in about 0.013 mass percent of the monomers in the mixture. Useful initiators for the copolymers of the present disclosure include any conventional initiator, including any conventional redox initiator.

In some embodiments the reductant of the redox initiator system can be ascorbic acid or a salt thereof. For example, the polymerization mixture can include sodium ascorbate in about 0.04 to about 0.1 mass percent of the monomers in the mixture. In other examples, the sodium ascorbate may be present in about 0.08 to about 0.1 mass percent of the monomers in the mixture. In some embodiments, the polymerization mixture includes sodium ascorbate in about 0.098 mass percent of the monomers in the mixture.

The initiator system may also include a metal salt. The metal may be any suitable transition metal, such as, for example, iron. In some embodiments, the metal salt of the initiator system can be ferrous sulfate ($FeSO_4$). In some embodiments, the metal salt is present in the polymerization mixture in about 0.0005 to about 0.1 mass percent of the monomers in the mixture. In some examples, the metal salt is added to the polymerization mixture as a solution.

The copolymer may also be under the form of a mixture further including a surfactant. In some embodiments, the surfactant may contain a sulfonate group. For example, the surfactant may include a dialkyl sulfosuccinate, such as, for example, dioctyl sulfosuccinate sodium salt. In some examples, the surfactant may be Aerosol® OT.

The copolymer can be a random copolymer, a block copolymer, or mixture thereof. In some embodiments, the copolymer is a substantially random copolymer (e.g., greater than 90, 95, 98, or 99 mass percent). In other examples, the copolymer is partially a random copolymer and partially a block copolymer. In these examples the weight percent ratio of random copolymer to block copolymer is generally 90:10, 80:20, 70:30, 60:40, 50:50, 40:60, 30:70, 20:80 or 10:90. The copolymer may also be a substantially block copolymer (e.g., greater than 90, 95, 98, or 99 weight percent). In other examples, the copolymer can contain additional monomers in addition to the monomers (A) selected from C6-C10 alkyl methacrylate monomers, and monomers (B) selected from C10-C18 alkyl methacrylate monomers. These additional monomers can be present in an amount less than 25 weight percent, preferably less than 10 weight percent. In some embodiments, the additional monomers are present in an amount from about 0.5 to 10 weight percent, or about 1 to 10 weight percent or about 1 to 5 weight percent or about 5 to 10 weight percent. In other embodiments, the additional monomers are present in an amount less than about 10, 9, 8, 7, 6, 5, 4, 3, 2, 1 or about 0.5 weight percent. The additional monomers can include, for example, C1-C5 alkyl methacrylates and C16-C24 alkyl methacrylates, cross-linking monomers, C1-C24 alkyl acrylates, styrene, and other similar monomers.

The copolymer may also be crosslinked. That is, the copolymer can contain monomeric units that connect one or more of the backbone chains of the polymer. In some examples, the copolymer contains crosslinked monomeric units present in up to about 5% by weight of the copolymer.

The crosslinked copolymer may be obtained by the addition of a crosslinking agent. In some embodiments, the crosslinking agent is a diacrylate or dimethacrylate crosslinking agent, such as, for example, 1,6-hexanediol dimethacrylate. In some examples, the mixture includes a crosslinking agent in up to about 0.005 mass percent of the monomers in the mixture.

Example copolymers are shown in Table 1. For each example, Table 1 shows the ratio of the mixture of methacrylate monomer (e.g. a mixture of monomers comprising C10 alkyl methacrylate, C12 alkyl methacrylate, C14 alkyl methacrylate, C16 alkyl methacrylate and C18 alkyl methacrylate) to C8 alkyl methacrylate monomer (e.g., 2-ethylhexyl methacrylate), the amount of acetone, the components of the redox initiator system, the surfactant used, the molecular weight, Rg and viscosity of each example copolymer.

For example, a method of making a copolymer as described above is disclosed. The method includes the polymerization of monomers (A) selected from C6-C10 alkyl methacrylate monomers, and monomers (B) selected from C10-C18 alkyl methacrylate monomers, advantageously polymerization of a mixture of monomers comprising C10 alkyl methacrylate, C12 alkyl methacrylate, C14 alkyl methacrylate, C16 alkyl methacrylate and C18 alkyl methacrylate, and a C8 alkyl methacrylate monomer, wherein the mass ratio of monomers (B) to monomers (A) in the copolymer is about 99:1 to about 10:90 by weight (e.g., 10:90, 15:85, 20:80, 25:75, 30:70, 35:65, 40:60, 45:55, 50:50, 55:45, 60:40, 65:35, 70:30, 75:25, 80:20, 85:15, 90:10, 95:5, 99:1).

The method includes: combining monomers (A) selected from C6-C10 alkyl methacrylate monomers, and monomers (B) selected from C10-C18 alkyl methacrylate monomers, advantageously combining a mixture of monomers comprising C10 alkyl methacrylate, C12 alkyl methacrylate, C14 alkyl methacrylate, C16 alkyl methacrylate and C18 alkyl methacrylate, and C8 alkyl methacrylate monomers in a ratio of about 10:90, 15:85, 20:80, 25:75, 30:70, 35:65, 40:60, 45:55, 50:50, 55:45, 60:40, 65:35, 70:30, 75:25, 80:20, 85:15, 90:10, 95:5, 99:1 and initiating the polymerization of the monomers to provide a copolymer.

For example, the ratio of monomers and the initiator, or initiator system, can be selected as described above. The method may include further components to provide a copolymer with desirable properties. For example, the method may also include a surfactant, such as, for example, Aerosol® OT, or a crosslinker, such as, for example, 1,6-hexanediol dimethacrylate.

Polymerization can occur in an aqueous mixture or a mixture that comprises both aqueous and organic solvents. For example, the polymerization mixture can include a mixture of water and acetone. In some embodiments the polymerization mixture may require an organic solvent. Often it will be desirable to include an organic solvent when C10-C18 alkyl methacrylates are in the polymerization mixture. Organic solvents for use in such polymerization reactions are known and routinely selectable by those of ordinary skill in the field of polymer synthesis. Suitable organic solvents include, for example and without limitation, acetone, 2-butanone, methanol, ethanol, and isopropanol.

According to the first and the second aspects of the present invention, the quantity of copolymer in the lubricant composition of the invention is from 0.01% to 10% by weight relative to the total weight of the lubricant composition, preferably from 0.01% to 5%, more preferably from 0.01% to 4%, further preferably from 0.01% to 3%. This quantity is to be construed as quantity of polymer dry matter. The copolymer used in the present invention is sometimes contained in dilution in a synthetic or mineral oil (most often a Group 1 oil according to the API classification).

Generally, the oils also called "base oils" used for formulating lubricant composition according to the present invention may be oils of mineral, synthetic or plant origin as well as their mixtures. The mineral or synthetic oils generally used in the application belong to one of the classes defined in the API classification as summarized below:

| | Saturated substance content (weight percent) | Sulfur content (weight percent) | Viscosity Index |
|---|---|---|---|
| Group 1 Mineral oils | <90% | >0.03% | 80 ≤ VI < 120 |
| Group 2 Hydrocracked oils | ≥90% | ≤0.03% | 80 ≤ VI < 120 |
| Group 3 Hydroisomerized oils | ≥90% | ≤0.03% | ≥120 |
| Group 4 | PAOs | | |
| Group 5 | Other bases not included in the base Groups 1 to 4 | | |

These mineral oils of Group 1 may be obtained by distillation of selected naphthenic or paraffinic crude oils followed by purification of these distillates by methods such as solvent extraction, solvent or catalytic dewaxing, hydrotreating or hydrogenation.

The oils of Groups 2 and 3 are obtained by more severe purification methods, for example a combination of hydrotreating, hydrocracking, hydrogenation and catalytic dewaxing. Examples of synthetic bases of Groups 4 and 5 include poly-alpha olefins, polybutenes, polyisobutenes, alkylbenzenes.

These base oils may be used alone or as a mixture. A mineral oil may be combined with a synthetic oil.

The lubricant compositions of the invention have a viscosity grade of SAE-20, SAE-30, SAE-40, SAE-50 or SAE-60 according to the SAEJ300 classification. Grade 20 oils have a kinematic viscosity at 100° C. of between 5.6 and 9.3 $mm^2/s$. Grade 30 oils have a kinematic viscosity at 100° C. of between 9.3 and 12.5 $mm^2/s$. Grade 40 oils have a kinematic viscosity at 100° C. of between 12.5 and 16.3 $mm^2/s$. Grade 50 oils have a kinematic viscosity at 100° C. of between 16.3 and 21.9 $mm^2/s$. Grade 60 oils have a kinematic viscosity at 100° C. of between 21.9 and 26.1 $mm^2/s$.

Preferably, the lubricant composition according to the first aspect and the second aspect is a cylinder lubricant.

The cylinder oils for two-stroke diesel marine engines have a viscosimetric grade SAE-40 to SAE-60, generally preferentially SAE-50 equivalent to a kinematic viscosity at 100° C. comprised between 16.3 and 21.9 $mm^2/s$. Typically, a conventional formulation of cylinder lubricant for two-stroke marine diesel engines is of grade SAE 40 to SAE 60, preferentially SAE 50 (according to the SAE J300 classification) and comprises at least 50% by weight of a lubricating base oil of mineral and/or synthetic origin, adapted to the use in a marine engine, for example of the API Group 1 class. Their viscosity index (VI) is comprised between 80 and 120; their sulfur content is greater than 0.03% and their saturated substance content is less than 90%.

The system oils for two-stroke diesel marine engines have a viscosimetric grade SAE-20 to SAE-40, generally preferentially SAE-30 equivalent to a kinematic viscosity at 100° C. comprised between 9.3 and 12.5 $mm^2/s$.

These viscosities may be obtained by mixing additives and base oils for example containing mineral bases of Group 1 such as Neutral Solvent (for example 150 NS, 500 NS or 600 NS) bases and brightstock. Any other combination of mineral, synthetic bases or bases of plant origin, having, as a mixture with the additives, a viscosity compatible with the chosen SAE grade, may be used.

The quantity of base oil in the lubricant composition of the invention is from 30% to 90% by weight relative to the total weight of the lubricant composition, preferably from 40% to 90%, more preferably from 50% to 90%.

In one embodiment of the invention, the lubricant composition has a Base Number (BN) determined according to the standard ASTM D-2896 of at most 50, preferably at most 40, advantageously at most 30 milligrams of potassium hydroxide per gram of the lubricating composition, in particular ranging from 10 to 40, preferably 15 to 40 milligrams of potassium hydroxide per gram of the lubricant composition.

In another embodiment of the invention, the lubricant composition has a BN determined according to the standard ASTM D-2896 of at least 50, preferably at least 60, more preferably at least 70, advantageously 70 to 100.

It is optionally possible to substitute the above-described base oils in full or in part by one or more thickening additives whose role is to increase both the hot and cold viscosity of the composition, or by additives improving the viscosity index (VI). The lubricant composition of the invention may comprise at least one optional additive, chosen in particular from among those frequently used by persons skilled in the art.

In one embodiment, the lubricant of the first aspect and the second aspect further comprises an optional additive chosen amongst a neutral detergent, an overbased detergent, an anti-wear additive, an oil soluble fatty amine, a polymer, a dispersing additive, an anti-foaming additive or a mixture thereof.

Detergents are typically anionic compounds containing a long lipophilic hydrocarbon chain and a hydrophilic head, wherein the associated cation is typically a metal cation of an alkali metal or alkaline earth metal. The detergents are preferably selected from alkali metal salts or alkaline earth metal (particularly preferably calcium, magnesium, sodium or barium) salts of carboxylic acids, sulphonates, salicylates, naphthenates, as well as the salts of phenates. These metal salts may contain the metal in an approximately stoichiometric amount relative to the anion group(s) of the detergent. In this case, one refers to non-overbased or "neutral" detergents, although they also contribute to a certain basicity. These "neutral" detergents typically have a BN measured according to ASTM D2896, of less than 150 mg KOH/g, or less than 100 mg KOH/g, or less than 80 mg KOH/g of detergent. This type of so-called neutral detergent may contribute in part to the BN of lubricating compositions. For example, neutral detergents are used such as carboxylates, sulphonates, salicylates, phenates, naphthenates of the alkali and alkaline earth metals, for example calcium, sodium, magnesium, barium. When the metal is in excess (amount greater than the stoichiometric amount relative to the anion groups(s) of the detergent), then these are so-called overbased detergents. Their BN is high, higher than 150 mg KOH/g of detergent, typically from 200 to 700 mg KOH/g of detergent, preferably from 250 to 450 mg KOH/g of detergent. The metal in excess providing the character of an overbased detergent is in the form of insoluble metal salts in oil, for example carbonate, hydroxide, oxalate, acetate, glutamate, preferably carbonate. In one overbased detergent, the metals of these insoluble salts may be the same as, or different from, those of the oil soluble detergents. They are preferably selected from calcium, magnesium, sodium or barium. The overbased detergents are thus in the form of micelles composed of insoluble metal salts that are maintained in suspension in the lubricating composition by the detergents in the form of soluble metal salts in the oil. These micelles may contain one or more types of insoluble metal salts, stabilised by one or more types of detergent. The overbased detergents comprising a single type of detergent-soluble metal salt are generally named according to the nature of the hydrophobic chain of the latter detergent. Thus, they will be called a phenate, salicylate, sulphonate, naphthenate type when the detergent is respectively a phenate, salicylate, sulphonate or naphthenate. The overbased detergents are called mixed type if the micelles comprise several types of detergents, which are different from one another by the nature of their hydrophobic chain. The overbased detergent and the neutral detergent may be selected from carboxylates, sulphonates, salicylates, naphthenates, phenates and mixed detergents combining at least two of these types of detergents. The overbased detergent and the neutral detergent include compounds based on metals selected from calcium, magnesium, sodium or barium, preferably calcium or magnesium. The overbased detergent may be overbased by metal insoluble salts selected from the group of carbonates of alkali and alkaline earth metals, preferably calcium carbonate. The lubricating composition may comprise at least one overbased detergent and at least a neutral detergent as defined above.

Polymers are typically polymers having a low molecular weight of from 2000 to 50 000 dalton (Mn). The polymers are selected amongst PIB (of from 2000 Dalton), polyacrylates or polymetacrylates (of from 30 000 Dalton), distinct from the copolymer based on monomers A and B, olefin copolymers, olefin and alpha-olefin copolymers, EPDM, polybutenes, poly alpha-olefin having a high molecular weight (viscosity 100° C.>150), hydrogenated or non-hydrogenated styrene-olefin copolymers.

Anti-wear additives protect the surfaces from friction by forming a protective film adsorbed on these surfaces. The most commonly used is zinc dithiophosphate or DTPZn. Also in this category, there are various phosphorus, sulphur, nitrogen, chlorine and boron compounds. There are a wide variety of anti-wear additives, but the most widely used category is that of the sulphur phospho additives such as metal alkylthiophosphates, especially zinc alkylthiophosphates, more specifically, zinc dialkyl dithiophosphates or DTPZn. The preferred compounds are those of the formula $Zn((SP(S)(OR_1)(OR_2))_2$, wherein $R_1$ and $R_2$ are alkyl groups, preferably having 1 to 18 carbon atoms. The DTPZn is typically present at levels of about 0.1 to 2% by weight relative to the total weight of the lubricating composition. The amine phosphates, polysulphides, including sulphurised olefins, are also widely used anti-wear additives. One also optionally finds nitrogen and sulphur type anti-wear and extreme pressure additives in lubricating compositions, such as, for example, metal dithiocarbamates, particularly molybdenum dithiocarbamate. Glycerol esters are also anti-wear additives. Mention may be made of mono-, di- and trioleates, monopalmitates and monomyristates. In one embodiment, the content of anti-wear additives ranges from 0.01 to 6%, preferably from 0.1 to 4% by weight relative to the total weight of the lubricating composition.

Dispersants are well known additives used in the formulation of lubricating compositions, in particular for application in the marine field. Their primary role is to maintain in suspension the particles that are initially present or appear in the lubricant during its use in the engine. They prevent their agglomeration by playing on steric hindrance. They may also have a synergistic effect on neutralisation. Dispersants used as lubricant additives typically contain a polar group, associated with a relatively long hydrocarbon chain, generally containing 50 to 400 carbon atoms. The polar group typically contains at least one nitrogen, oxygen, or phosphorus element. Compounds derived from succinic acid are particularly useful as dispersants in lubricating additives. Also used are, in particular, succinimides obtained by condensation of succinic anhydrides and amines, succinic esters obtained by condensation of succinic anhydrides and alcohols or polyols. These compounds can then be treated with various compounds including sulphur, oxygen, formaldehyde, carboxylic acids and boron-containing compounds or zinc in order to produce, for example, borated succinimides or zinc-blocked succinimides. Mannich bases, obtained by polycondensation of phenols substituted with alkyl groups, formaldehyde and primary or secondary amines, are also compounds that are used as dispersants in lubricants. In one embodiment of the invention, the dispersant content may be greater than or equal to 0.1%, preferably 0.5 to 2%, advantageously from 1 to 1.5% by weight relative to the total weight of the lubricating composition. It is possible to use a dispersant from the PIB succinimide family, e.g. boronated or zinc-blocked.

Other optional additives may be chosen from defoamers, for example, polar polymers such as polydimethylsiloxanes, polyacrylates. They may also be chosen from antioxidant and/or anti-rust additives, for example organometallic detergents or thiadiazoles. These additives are known to persons skilled in the art. These additives are generally present in a weight content of 0.1 to 5% based on the total weight of the lubricating composition.

In one embodiment, the lubricant composition according to the invention may further comprise an oil soluble fatty amine.

The fatty amine is of a general formula (I):

$$R_1—[(NR_2)—R_3]_n—NR_4R_5, \quad (I)$$

wherein, $R_1$ represents a saturated or unsaturated, linear or branched, hydrocarbon group comprising at least 12 carbon atoms, and optionally at least one heteroatom chosen amongst nitrogen, sulfur or oxygen, $R_2$, $R_4$ and $R_5$ represent independently a hydrogen atom or a saturated or unsaturated, linear or branched, hydrocarbon group comprising optionally at least one heteroatom chosen amongst nitrogen, sulfur or oxygen, $R_3$ represents a saturated or unsaturated, linear or branched, hydrocarbon group comprising at least 1 carbon atom, and optionally at least one heteroatom chosen amongst nitrogen, sulfur or oxygen, preferably oxygen, n is an integer, n is superior or equal to 1, preferably comprised between 1 and 10, more preferably between 1 and 6, notably chosen amongst 1, 2 or 3. Preferably, the fatty amine is of a general formula (I), wherein:

$R_1$ represents a saturated or unsaturated, linear or branched, hydrocarbon group comprising between 12 and 22 carbon atoms, preferably between 14 and 22 carbon atoms, and optionally at least one heteroatom chosen amongst nitrogen, sulfur or oxygen, and/or $R_2$, $R_4$ and $R_5$ represent independently a hydrogen atom; a saturated or unsaturated, linear or branched, hydrocarbon group comprising between 12 and 22 carbon atoms, preferably between 14 and 22 carbon atoms, more preferably between 16 and 22 carbon atoms; a $(R_6—O)_p—H$ group wherein $R_6$ represents a saturated, linear or branched, hydrocarbon group comprising at least 2 carbon atoms, preferably between 2 and 6 carbon atoms, more preferably between 2 and 4 carbon atoms, and p is superior or equal to 1, preferably comprised between 1 and 6, more preferably comprised between 1 and 4; a $(R_7—N)_p—H_2$ group wherein $R_7$ represents a saturated, linear or branched, hydrocarbon group comprising at least 2 carbon atoms, preferably between 2 and 6 carbon atoms, more preferably between 2 and 4 carbon atoms, and p is superior or equal to 1, preferably comprised between 1 and 6, more preferably comprised between 1 and 4, and/or $R_3$ represents a saturated or unsaturated, linear or branched, alkyl group comprising between 2 and 6 carbon atoms, preferably between 2 and 4 carbon atoms.

In one embodiment, the fatty amine of general formula (I) represents of from 0.5 to 10%, preferably of from 0.5 to 8% by weight with respect to the total weight of the lubricant composition.

The optional additives such as defined above contained in the lubricant compositions of the present invention can be incorporated in the lubricant composition as separate additives, in particular through separate addition thereof in the base oils. However, they may also be integrated in a concentrate of additives for marine lubricant compositions.

Advantageously, the lubricant composition comprises:

from 50 to 90% of at least one base oil, from 0.01 to 10% of at least one copolymer based on Monomers (A) and Monomers (B) as above defined the percentages being defined by weight of component as compared to the total weight of the composition.

Even more advantageously, the lubricant composition comprises:

from 70 to 90% of at least one base oil from 0.01 to 5% of at least one copolymer based on Monomers (A) and Monomers (B) as above defined, the percentages being defined by weight of component as compared to the total weight of the composition.

In a third aspect, the present disclosure provides a method for producing a marine lubricant of the first and the second aspects comprising the step of mixing the base oil with the copolymer as above defined.

Preferably, the method according to the invention comprises the step of further mixing the mixture comprising the base oil and the copolymer as above defined with at least one fatty amine of general formula (I) and optionally at least one additional additive.

In a fourth aspect, the present disclosure provides the use of a lubricant composition according to the first and the second aspects for lubricating two-stroke marine engine. In particular, the lubricant composition is suitable for 2-stroke engines as cylinder oil or system oil.

Alternately, the present disclosure provides a method for lubricating a two-stroke marine engine said method comprising application to said two-stroke marine engine of the marine lubricant of the first and the second aspects. The lubricant is applied to the cylinder wall, typically by a pulse lubricating system or by spraying the lubricant onto the piston's rings pack through an injector. It has been observed that applying to the cylinder wall the lubricant composition according to the first and second aspect of the invention provides increased protection against corrosion.

In a fifth aspect, the present disclosure provides the use of a lubricant composition according to the first and the second aspects for reducing the disruption of the lubricant jet before its impact, notably onto the pistons ring pack system.

Alternately, the present disclosure provides a method for reducing the disruption of the lubricant jet before its impact, notably before its impact onto the piston's rings pack, said method comprising formulating the marine lubricant according to the first and the second aspects and projecting the marine lubricant as a jet.

In one embodiment, the reduction of the disruption of the lubricant jet before its impact, notably onto the pistons ring pack system, results from the enhancement of the rheology properties of the lubricant, notably the jet rheology properties of the lubricant. The term "jet rheology properties" of the lubricant means the rheological properties of the lubricant when the lubricant forms a jet.

A test measuring the enhanced lubrication properties and usability of lubricant compositions of the first aspect and the second aspects was undertaken under the following conditions. The lubricant compositions comprising the oil/copolymer were examined for performance/suitability as a lubricant by a finger pull test. This test is performed by pipetting a droplet of sample fluid (about 65 μl) onto the thumb of a gloved hand. The thumb and forefinger are gently squeezed together to ensure contact of the droplet with both fingers, then the fingers are pulled apart vertically for about 1 second over a distance of about 7.5 cm, while observing the amount of time the composition provides a fluid connection between the thumb and forefinger after the fingers have been moved apart. All finger pull tests were performed at ambient temperature, about 21° C. The performance of the sample was characterized as "very short," "short," "medium" or "long" depending upon the duration that a fluid connection between thumb and forefinger remains. Compositions with "very short" performance in the finger pull test being less than 1.0 seconds, "short" ranging from 1.0-4.0 seconds, "medium" ranging from 4.1-7.0 seconds, and "long" being more than 7.0 seconds. Compositions with "very short" textures do not exhibit enhanced suitability or performance as a lubricant. Compositions with "short," "medium," or "long" textures exhibit improved suitability as a lubricant to varying degrees because, for example, their ability to effectively form a jet without being disrupted before impact on the cylinder wall of the engine being lubricated is enhanced. Compositions with "long" texture have particularly good suitability as a lubricant. The results of the finger pull test are shown in Table 1.

In an embodiment the polymers have a molecular weight superior than 20000 D.

In an embodiment the polymers have a bimodal molecular weight distribution.

Copolymers having a molecular weight (Mw), average root mean square radius of gyration (Rg) and viscosity correlation in a certain range are particularly suitable as an oil additive to enhance the performance of oil as a lubricant while maintaining the ability to handle and pump the oil. A preferred correlation of a bimodal Mw, Rg and viscosity values for one embodiment of the copolymers disclosed herein is represented by the following formula:

$$\text{Performance } X = 1139.69418 + (2.54756 * \text{Peak 1 Mw}) - (0.91396 * \text{Peak 1 Rg}) - (66.18535 * \text{Peak 2 Mw}) - (0.23020 * \text{Viscosity} + 1.18947\text{E}-003 * \text{Peak 1 Rg}) * (\text{Viscosity}),$$

where the units for Mw is $10^6$ g/mol, Rg is nm, and Viscosity is mPa·s, as set forth in Table 1. A performance X value between 500 and 900, more preferably between 550 and 800, and most preferably between 600 and 750 is indicative of a copolymer having properties that are particularly suitable to enhance the performance of oil as a lubricant, notably the jetting of the lubricant.

Definitions

As used herein, C10-C18 alkyl methacrylate is a mixture of C10 alkyl methacrylate, C12 alkyl methacrylate (CAS 142-90-5), C14 alkyl methacrylate (CAS 2549-53-3), C16 alkyl methacrylate (CAS 2495-27-4) and C18 alkyl methacrylate. For example, this mixture comprises of about—0.1 to 2% by weight of C10 alkyl methacrylate, 50 to 80% by weight of C12 alkyl methacrylate, 15 to 40% by weight of C14 alkyl methacrylate, 2 to 12% by weight of C16 alkyl methacrylate and 0.1 to 1% by weight of C18 alkyl methacrylate as compared to the total weight of the mixture, such as commercially available methacrylic ester 13.0 (Evonik trade name: VISIOMER® Terra C13,0-MA).

As used herein, the term "about" refers to the given value±10% of the value.

As used herein, the term "C8 alkyl" refers to a group comprised of eight saturated carbon atoms connected in a linear or branched configuration. Examples of linear C8 alkyl groups include n-octyl. Examples of branched $C_8$alkyl groups include, but are not limited, to 2-ethylhexyl.

As used herein, the expression "comprised between x and y", wherein x and y are numerical values, means that the value may be x, or y or may be any value from x to y.

It is noted that any embodiment disclosed herein can be combined with any other embodiment with the result being subject matter in accordance with the invention.

It is noted that, unless used differently, "%" means percent by weight.

EXAMPLES

C10-C18 alkyl methacrylate as used in Examples 1 and 2 was provided as methacrylic ester 13.0, which is commercially available as VISIOMER Terra C13,0-MA from Evonik Industries.

Example 1

To a 4-neck 2000 mL flask equipped with an overhead stirrer, a condenser, a thermocouple and a subsurface nitrogen purge was added 645.5 g of water and 8.7 g of Aerosol® OT. The stirring was turned up to 200 rpm and the subsurface nitrogen purge was started. To the reaction mixture was then added 270.0 g of C10-C18 alkyl methacrylate, 30.0 g of 2-ethylhexyl methacrylate and 129.9 g of acetone. The reaction was heated up to 43° C. by using a temperature controlled water batch set at 45° C. Once the reaction reached 43° C., 0.04 g of t-butyl hydroperoxide in 7.5 g of water was added. After 5 minutes, 0.29 g of sodium ascorbate dissolved in 7.5 g of water and 0.60 g of a 0.25% solution of iron sulfate hexahydrate was added. The nitrogen purge was then changed to a nitrogen blanket. The reaction was held an additional 5 hours, cooled to room temperature and isolated.

Example 2

To a 4-neck 2000 mL flask equipped with an overhead stirrer, a condenser, a thermocouple and a subsurface nitrogen purge was added 645.5 g of water and 8.7 g of Aerosol® OT. The stirring was turned up to 200 rpm and the subsurface nitrogen purge was started. To the reaction mixture was then added 240.0 g of C10-C18 alkyl methacrylate, 60.0 g of 2-ethylhexyl methacrylate and 129.9 g of acetone. The reaction was heated up to 43° C. by using a temperature controlled water batch set at 45° C. Once the reaction reached 43° C., 0.04 g of t-butyl hydroperoxide in 7.5 g of water was added. After 5 minutes, 0.29 g of sodium ascorbate dissolved in 7.5 g of water and 0.60 g of a 0.25% solution of iron sulfate hexahydrate was added. The nitrogen purge was then changed to a nitrogen blanket. The reaction was held an additional 5 hours, cooled to room temperature and isolated.

Preparation of a Test Lubricant Composition Comprising 5% Solids Solution of Copolymer in Oil To a 4-neck 1000 mL flask equipped with an overhead stirrer, a Barrett distillation trap with a condenser and a thermocouple was added an amount of the emulsion of any of Examples 1 and 2 to give 20.0 g of polymer. Neutral Solvent 600 was then added to bring the total up to 400.0 g, followed by 150.0 g of toluene. The stirring was turned up to 200 rpm and the mixture was brought up to reflux. As water condensed in the Barrett trap it was drained off. Once the water stopped overflowing, the contents of the reactor were brought up to 130° C. to distill of a majority of the toluene. The remaining material was transferred to a 1000 mL single neck round bottom and concentrated at vacuum with a bath at 60° C. until the material reached a constant weight.

The test lubricant was submitted to the above disclosed finger pull test.

Method for Determining Molecular Weight and Radius of Gyration

The Molecular Weight and Radius of Gyration of the polymer samples, supplied at 5% solids in base oil, was determined by the procedure outlined below:

Eluant: HPLC Grade Tetrahydrofuran stabilized with 0.01% Butylated Hydroxytoluene Column: Phenogel Guard Column 100A 10 um 300 mm×7.8 mm.

Flow Rate: 0.50 ml/min.

Detectors: Wyatt Dawn Heleos-II MultiAngle Light Scattering (MALS) at 663 nm and room temperature and Wyatt Optilab T-rEX Refractive Index Detector at 658 nm and 40° C.

Pump/Autosampler: Agilent 1100 Isocratic HPLC Pump and Autosampler

Column Compartment: 40° C.

Standards: There were no standards directly correlated with the analysis, but the Heleos-II MALS calibration constant was established with Toluene and the Optilab T-rEX calibration constant was established with NaCl in water. The 17 angles on the Heleos-II were normalized with a narrow range polystyrene standard at 28,500 daltons Molecular Weight and the detector delay volume was adjusted with the same standard.

Sample Preparation: The samples were prepared by gravimetrically diluting about 8.0 mg of sample with about 5.0 g of tetrahydrofuran. The actual concentration of polymer in mg/ml was calculated based on the density of tetrahydrofuran (0.889 g/ml) and the percentage solids in the sample solutions (5.0%).

Injection: 50

Run time: 20 minutes.

Software: Wyatt Astra Version 6.1.4.25.

Calculations: The Astra software provides several choices of formalisms and exponent order to fit the data. All samples were fit with a $2^{nd}$ order Berry. The angles used were adjusted to give the best fit, using a minimum of 13 angles and up to the maximum of 17. The dn/dc was calculated from the refractive index data assuming 100% recovery. The software reported the average Molecular Weight as Mw and the average Root Mean Square Radius of Gyration as Rg. The results are shown in Table 1.

Method for Determining Viscosity

The shear viscosity of the polymer samples, supplied at 5% solids in base oil, was determined by stress-controlled rheometer MCR 302, manufactured by Anton Paar GmbH, located at Anton Paar Strasse 20, 8054, Graz, Austria. The Double Gap System of Measurement was used for good accuracy (Instruction Manual, MCR Series, Modular Compact Rheometer MCR 52/102/302/502, page 50, Anton Parr, Graz, Austria, 2011). The temperature was set at 22° C. with the accuracy of 0.1° C. The shear rate was gradually increased from 1/sec to 100/sec with 10 points of viscosity reading per decade. At each of these points, 10 seconds equilibrium time was given before the reading, which lasted 3 seconds. The viscosity at 10/sec shear rate is shown in Table 1. Software for instrument control and data acquisition is RheoCompass™, version 1.13.445.

TABLE 1

| Example | LMA[1] | 2-EHMA[1] | Acetone[2] | TBHP[2] | Ascorbate[2] | FeSO4[2] (0.25%) | Aerosol OT[2] |
|---|---|---|---|---|---|---|---|
| 1 | 90 | 10 | 43.3 | 0.013 | 0.098 | 0.20 | 2.90 |
| 2 | 80 | 20 | 43.3 | 0.013 | 0.098 | 0.20 | 2.90 |
| NS600 Base Oil | — | — | — | — | — | — | — |

| Example | Mw Peak 1 ($10^6$ g/mol) | Mw Peak 2 ($10^6$ g/mol) | Rg Peak 1 (nm) | Rg Peak 2 (nm) | 5% S NS600 viscosity [mPa · s] | Finger Pull Test[3] |
|---|---|---|---|---|---|---|
| 1 | 133 | 6.4 | 140 | 108 | 3610 | L |
| 2 | 133 | 7.0 | 135 | 104 | 2152 | L |
| NS600 Base Oil | — | — | — | — | 300 | Vs |

[1]Percentage of monomer as a mass percent of the total amount of monomer
[2]Parts per hundred based on the total amount of monomer
[3]vs = very short, s = short, m = medium, l = long
LMA = C10-C18 alkyl methacrylate;
2-EHMA = 2-ethylhexyl methacrylate.

Example Lubricant Compositions

Lubricant compositions C1 and C2, have been prepared with the following compounds:

lubricating base oil 1: Group I Mineral oils or brightstock of density between 895 and 915 kg/m$^3$, lubricating base oil 2: Group I mineral oils, in particular called 600R viscosity at 40° C. of 120 cSt measured according to ASTM D7279, detergent package comprising an anti-foaming agent, fatty amine, polymer from example 2.

The compositions C1 and C2 are disclosed in Table 2. The percentages disclosed in Table 2 correspond to weight percent.

TABLE 2

| Composition | C1 | C2 |
|---|---|---|
| Base oil 1 | 18.0 | 18.0 |
| Base oil 2 | 54.6 | 49.6 |
| Detergent package | 26.9 | 26.9 |
| Fatty amine | 0 | 5.0 |
| Polymer from example 2 | 0.5 | 0.5 |

What is claimed:

1. A lubricant composition comprising:

from 0.01% to 10% by weight, relative to the total weight of the lubricant composition, of a copolymer of alkyl methacrylate monomers, wherein the alkyl methacrylate monomers consist essentially of:

a. Monomers (A) selected from C6-C10 alkyl methacrylate monomers, and b. Monomers (B) selected from C10-C18 alkyl methacrylate monomers, the Monomers (B) comprising a mixture of about 0.1 to 2% by weight of C10 alkyl methacrylate, about 50 to 80% by weight of C12 alkyl methacrylate, about 15 to 40% by weight of C14 alkyl methacrylate, about 2 to 12% by weight of C16 alkyl methacrylate and about 0.1 to 1% by weight of C18 alkyl methacrylate based on a total weight of the mixture, wherein the copolymer is obtained by combining the Monomers (A) and the Monomers (B) in a mixture consisting essentially of the Monomers (A) and the Monomers (B) and co-polymerizing the monomers, the mass ratio of the Monomers (B) to the Monomers (A) being from 90:10 to 80:20, and wherein the copolymer has an average Root Mean Square Radius of Gyration (Rg), as measured by Hydrodynamic Column Chromatography-Multi Angle Light Scattering (HCC-MALS), of from 100 to 200 nm, and a base oil.

2. The lubricant composition according to claim 1, wherein monomers (A) are branched.

3. The lubricant composition according to claim 2, wherein Monomers (A) are 2-ethyl hexyl methacrylate.

4. The lubricant composition according to claim 1, wherein Monomers (B) are linear.

5. The lubricant according to claim 1, wherein the lubricant further comprises an optional additive chosen amongst a neutral detergent, an overbased detergent, an anti-wear additive, a fatty amine soluble in lubricant, a polymer, a dispersing additive, an anti-foaming additive or a mixture thereof.

6. The lubricant according to claim 1, wherein the lubricant composition is a marine lubricant having a BN determined according to the standard ASTM D-2896 of at most 50 milligrams of potassium hydroxide per gram of the lubricant composition.

7. The lubricant according to claim 1, wherein the lubricant composition is a marine lubricant having a BN determined according to the standard ASTM D-2896 of at least 50 milligrams of potassium hydroxide per gram of the lubricant composition.

8. A method for lubricating two-stroke marine engines comprising applying a composition according to claim 1 as a lubricant composition to at least one component of a two-stroke marine engine.

9. The method according to claim 8, for reducing the disruption of the lubricant jet before its impact.

10. The method according to claim 9, for reducing the disruption of the lubricant jet before its impact onto a pistons ring pack system.

* * * * *